US006588180B2

(12) United States Patent
Heath et al.

(10) Patent No.: US 6,588,180 B2
(45) Date of Patent: Jul. 8, 2003

(54) CONSTRICTED NECK BLISTER PACK AND APPARATUS AND METHOD FOR MAKING THE SAME

(75) Inventors: Kenneth Heath, Carms (GB); Kevin William Greaves, Swansea (GB)

(73) Assignee: R. P. Scherer Technologies, Inc., Paradise Valley, NV (US)

( * ) Notice: Subject to any disclaimer, the term of this patent is extended or adjusted under 35 U.S.C. 154(b) by 0 days.

(21) Appl. No.: 09/775,952

(22) Filed: Feb. 2, 2001

(65) Prior Publication Data

US 2002/0112449 A1 Aug. 22, 2002

(51) Int. Cl.[7] ..... B65B 47/04; B65B 63/08

(52) U.S. Cl. ..... 53/440; 53/453; 206/531; 206/534; 264/292; 425/398

(58) Field of Search ..... 53/440, 453, 127, 53/559; 206/531, 532, 534, 77.1, 445; 425/398; 264/291, 292, 320, 325

(56) References Cited

U.S. PATENT DOCUMENTS

| | | | | | |
|---|---|---|---|---|---|
| 3,054,503 | A | * | 9/1962 | Hartman, Jr. et al. | 206/531 |
| 3,103,774 | A | * | 9/1963 | Wall | 53/453 |
| 3,380,578 | A | * | 4/1968 | Sparks | |
| 4,305,502 | A | | 12/1981 | Gregory et al. | |
| 4,495,135 | A | * | 1/1985 | White | |
| 4,496,052 | A | * | 1/1985 | Nertman | 53/453 |
| 5,039,540 | A | | 8/1991 | Ecanow | |
| 5,079,018 | A | | 1/1992 | Ecanow | |
| 5,135,383 | A | * | 8/1992 | Marchesini | 425/398 |
| 5,215,756 | A | | 6/1993 | Gole et al. | |
| 5,298,261 | A | | 3/1994 | Pebley et al. | |
| 5,343,672 | A | * | 9/1994 | Kearney et al. | 53/440 |
| 5,457,895 | A | | 10/1995 | Thompson et al. | |
| 5,529,188 | A | * | 6/1996 | Coggswell | 206/531 |
| 5,560,490 | A | * | 10/1996 | Chawla | |
| 5,613,609 | A | * | 3/1997 | Hamilton et al. | 206/531 |
| 5,833,071 | A | * | 11/1998 | Ray | 206/532 |
| 5,879,612 | A | * | 3/1999 | Zeiter et al. | 264/292 |
| 5,954,204 | A | * | 9/1999 | Grabowski | 206/531 |

FOREIGN PATENT DOCUMENTS

| | | | |
|---|---|---|---|
| EP | 0 563 934 A1 | | 3/1993 |
| EP | 0 646 367 B1 | | 11/1993 |
| EP | 0 710 101 B1 | | 11/1993 |
| EP | 0 905 042 A1 | | 9/1997 |
| JP | 58-126118 | * | 7/1983 |
| WO | WO 93/127/69 | | 7/1993 |
| WO | WO 00/09313 | | 2/2000 |

OTHER PUBLICATIONS

US 5,120,549, 6/1992, Gole et al. (withdrawn)

* cited by examiner

*Primary Examiner*—Stephen F. Gerrity
(74) *Attorney, Agent, or Firm*—Andrew G. Rozycki

(57) ABSTRACT

A blister pack which confines the movement a dosage form in order to resist damage thereto during handling and transportation while permitting removal of the intact dosage form, and apparatus and methods for the same. In particular, the invention provides a blister pack wherein the blister includes a protruding region between the opening and the base, thereby producing a constricted area or "neck" in the blister. In a preferred embodiment, the protruding region comprises an inwardly directed annulus formed in the blister wall. Accordingly, vertical movement of the dosage form is confined as a result of the protruding region, thereby reducing the likelihood of damage to the dosage form caused by agitation of the blister pack. The invention is particularly useful in packaging frangible pharmaceutical dosage forms formed in situ within the blister, such as freeze dried dosage forms and rapidly dissolving oral dosage forms.

44 Claims, 3 Drawing Sheets

CONSTRICTED NECK BLISTER PACK AND APPARATUS AND METHOD FOR MAKING THE SAME

FIELD OF THE INVENTION

The invention relates to the field of pharmaceutical packaging and shipment. In particular, the invention pertains to blister packaging and manufacturing techniques.

BACKGROUND OF THE INVENTION

Blister packs have been commonly used to package a variety of products or dosage forms in which the individual units of the product are contained or housed separately from each other. Typically, blister packs contain an array or series of blisters positioned in a square or rectangular-shaped film. Each blister contains the product therein and is covered with a lidding or cover layer adhesively secured to the film layer at least at the perimeter of the top of each blister. This lidding seals the blister and protects the contents therein by isolating the contents from the environment.

Blisters in blister packs are typically manufactured by deforming a film layer. Forming the blister in the film is accomplished by hot or cold forming techniques whereby a section of the film is forced into a mold defining a recess having the substantially similar dimensions to the desired shape of the blister to be created. Other blister-forming techniques include blow forming and vacuum forming softened films against a die. Blisters can be produced in a variety of shapes and sizes, and typically come in circular, square or rectangular overall cross-sections.

Blister packs are often used to house or contain a loose product which is relatively robust and capable of withstanding movement within the blister during transportation and storage. Blister packs can also have the dual function as both a mold itself as part of the manufacturing process of the dosage form, as well as the containment and packaging for the in situ molded dosage form. An example of such a technique is disclosed in Thompson et al., U.S. Pat. No. 5,457,895. Accordingly, in situ molded dosage forms can be prepared by depositing the liquid form of the composition directly in the blister and subsequently treating the blister and its contents to the process which solidifies the composition to form the final dosage form. This technique is used to prepare freeze dried or lyophilized dosage forms, for example. The method of producing these in situ formed dosage forms often results in shrinkage of the product thereby producing room for movement of the product inside the blister. Certain dosage forms are relatively fragile or frangible as a result of their manufacturing process and desired administration properties. Such dosage forms include rapidly dissolving oral dosage forms, whereby the dosage form rapidly disintegrates in the patient's oral cavity.

Blister packs having blisters with narrow openings used to contain solid dosage forms are known, such as those disclosed in Eggert et al., European Patent Application 563 934. These blister packs, however, are not specifically designed for use with frangible pharmaceutical dosage forms, in particular dosage forms molded in situ within the blister. In situ molding techniques for pharmaceutical dosage forms and the blister packs therefore are described in Thompson et al., U.S. Pat. No. 5,457,895 and Heath in PCT WO 00/09313. These blister packs, however, do not prevent the movement of the dosage form within the blister in the space directly beneath the lidding.

During manufacture, unsecured blister contents can often fall out and become damaged during the inspection and sealing stages of the manufacturing process. During in situ molding techniques, the dosage form often shrinks and detaches from the blister walls. Dislodging of blister contents during the sealing process can also interfere with sealing tools and equipment. Another problem associated with blister packs is the damage to the contents as a result of agitation or movement inside the blister that can result from handling, transportation and storage of the pack. This is especially problematic for frangible pharmaceutical products or dosage forms, such as rapidly dissolving oral dosage forms, wherein agitation of the packaging can produce crumbling or fragmenting of the product. Even more challenging is the design of a blister pack which could both confine the movement of frangible contents while at the same time permitting easy removal of the intact dosage form from the blister.

Thus, there exists a need for improved blister packs which restrict the range of movement if its contents without overly inhibiting the intact removal of the contents, especially in the packaging of frangible pharmaceutical products or dosage forms.

SUMMARY OF THE INVENTION

The invention described provides a blister pack which confines the movement its contents in order to reduce the likelihood of damage thereto during manufacture, handling and transportation while at the same time permitting easy removal of the contents intact. In particularly, the invention provides a blister pack wherein the blister includes a protruding region between the opening of the blister and the base, thereby producing a constricted portion or "neck" near the opening of the blister. In one embodiment, the protruding region of the blister comprises an inwardly directed annulus formed in the blister wall. Accordingly, vertical movement of the contents is confined as a result of the protruding region thereby minimizing the impact on the contents caused by agitation of the blister pack. It has been discovered that a protruding region can be formed in a blister such that both the movement of the contents can be confined, while at the same time permitting easy removal of the contents intact. The invention is particularly useful in the packaging frangible pharmaceutical products, such as freeze dried dosage forms and rapidly dissolving oral dosage forms, and products formed in situ within the blister. It has been further discovered that the invention allows for both the formation of the blister and its use for in situ molding techniques to efficiently prepare and package frangible pharmaceutical products, such as freeze dried dosage forms. Yet another advantage is that the blister packs of the invention hold the frangible dosage form in place and prevent their dislodging during the manufacturing process which commonly occurs from shrinking of the dosage form and physical impact of machinery.

The invention provides for a blister pack for pharmaceutical products comprising a blister formed from a film and having a protruding region between the opening of the blister and its base, the protruding region being adapted to confine the movement of contents placed within the blister. The protruding region can be in the form of an inwardly directed annulus or a plurality of inwardly directed projections on the wall of the blister. The blister pack according to the invention can further comprise an indicia formed on the base of the blister.

The invention further provides for an apparatus for forming a blister from a deformable film and having a protruding region positioned between the opening and base comprising a) a pin having a body, end portion and outer surface, wherein the outer surface contains at least one peripheral recess on said end portion and which defines the protruding region to be formed in the blister, and wherein the end portion defines the base portion of the blister; and b) a die adapted to receive the pin and having a platen, wherein the pin is adapted to transversely contact a film positioned between the pin and die and engage the die in a manner which moves the film inside the die; wherein the peripheral recess on the pin is adapted to permit inward deformation of the film. The apparatus can further comprise at least one indicia forming surface located on the pin face or platen of the die, or both. Furthermore, the apparatus can comprise an air pressure control means for monitoring and controlling the air pressure between the film and chamber of the die during the molding process.

The invention also provides for a method of forming a blister from a film having a protruding region between the opening and the base thereof comprising a) positioning a deformable film between a pin and die, the pin having at least one peripheral recess on its outer surface at the end portion which defines the protruding region of the blister, and engaging the pin and die in a manner whereby the pin defines the blister and the recess on the outer surface of the pin receives a portion of the film and defines the protruding region of the blister.

The invention further provides for a method of packaging a frangible pharmaceutical dosage form comprising depositing the frangible dosage form into a blister having a protruding region between the opening and base of the blister, and covering the blister containing the dosage form to protect the dosage form from the environment.

The invention also provides for a method of forming a freeze dried pharmaceutical dosage form comprising depositing the liquid form of a pharmaceutical composition into a blister having a protruding region between the opening and the base of the blister and freeze drying the liquid composition in situ to form the solid dosage form.

DETAILED DESCRIPTION OF THE INVENTION

The terms "dosage form," "contents," and "product," when mentioned within the context of that which is contained or held in the blister or blister pack, are interchangeable terms for any composition or substance capable of being packaged in a blister pack, including but not limited to pharmaceutical products or medicaments, both human and veterinary.

The term "blister" is used as a general description of the type of packaging commonly found in the pharmaceutical field, and is not intended to imply limitation to an overall shape of a rounded hemispherical dome.

The terms "neck" and "constriction" when used in reference to the configuration of the blister are meant to generally refer to the region of the blister having the reduced cross-sectional area between the opening of the blister and the base of the blister.

The term "protruding region" when used to describe the blister according to the invention is meant to indicate the portion of the blister between the opening of the blister and its base which is inwardly directed. The term "region" in this sense is meant to encompass both single or contiguous protrusions as well as two or more intermittent protrusions collectively reducing the horizontal cross sectional area of the blister. Thus, the term refers to the overall reduction in the diameter of a horizontally planar cross section of the blister relative to the immediately adjacent blister wall.

The terms "indicia" or "mark" as used in the context of embossing of the blister film are meant to include any letter, number, symbol, trademark or logo or other identifier capable of being formed on a blister film. Indicia or marks can include manufacturer logos, dosage or active ingredient amounts, as well as partition lines and the like.

The term "base portion" when used to refer to the blister is meant to describe the portion of the blister below the opening, and the term "base" is meant to refer to the bottom-most portion of the blister. These terms are not intended to imply the presence of a planar configuration of the bottom region of the blister.

The term "boss" as used herein is meant to indicate a raised portion of a surface, and the term "dint"as used herein is meant to indicate a recessed portion of a surface. When the terms are used within the context of forming an indicia in a deformable film, the terms refer to the surfaces which create a positive or negative imprint into the film.

Figure 1:
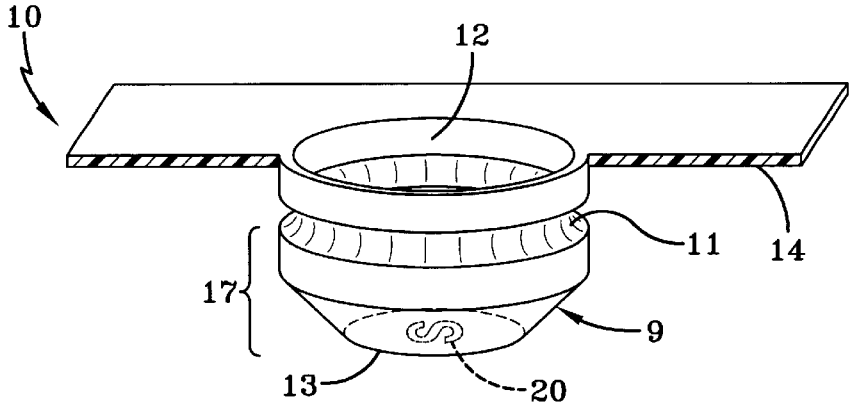
FIG. 1 is an angled cut-away side view of a single blister having a protruding region in the form of an inwardly directed annulus in accordance with one embodiment of the invention.
Figure 2:
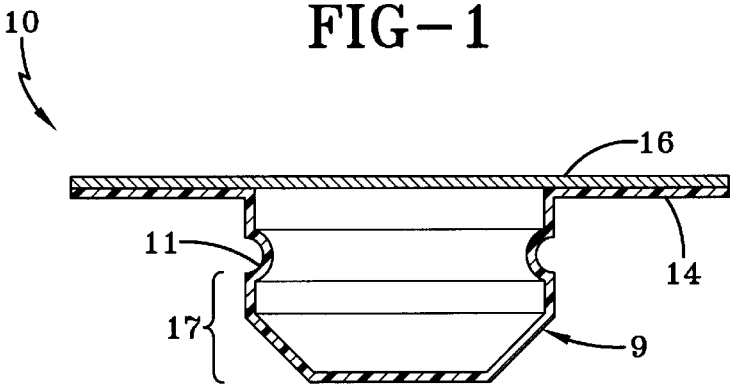
FIG. 2 is a vertical cross-sectional view of the interior of a lidded single blister having a protruding region in accordance with one embodiment of the invention.
Figure 3:
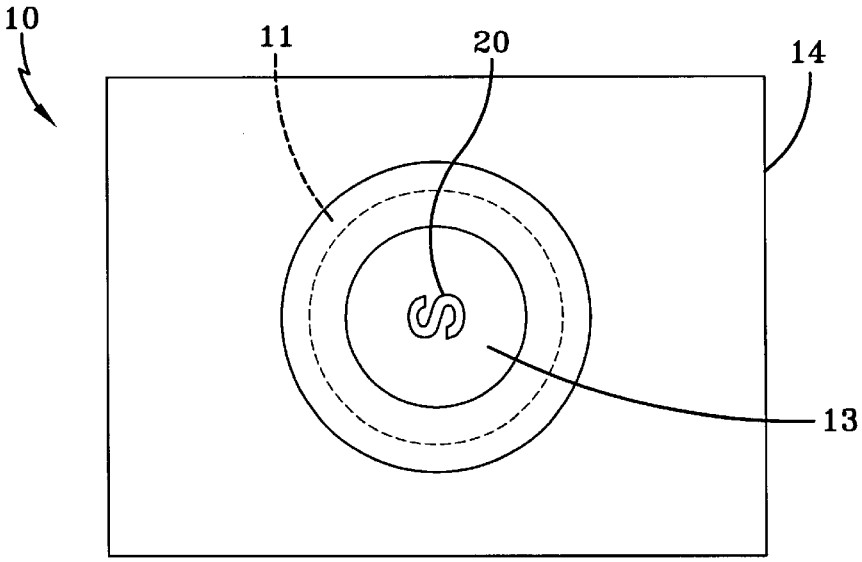
FIG. 3 is a top view of a single unlidded blister having a protruding region in the form of an inwardly directed annulus in accordance with one embodiment of the invention.

Referring now to FIGS. 1 through 3, blister packs 10 contain at least one blister 9 formed from a film 14 and having a base 13 and opening 12, the opening 12 being covered with a sheet layer 16 to protect the contents (not shown) inside the blister 9 from the surrounding environment until the time of use. The blister pack 10 in accordance with the invention contains a protruding region 11 (e.g., constricted region or "neck") located between the opening 12 and the base portion 17 of the blister 9, and is adapted to retain contents located between the protruding region 11 and base 13 thereby confining the movement (e.g., vertical movement) thereof. The extent of protrusion can vary according to the dimensions (e.g., size, shape, configuration) of the blister, the configuration and properties of the product to be used in conjunction with the blister packs, as well as the film material used to form the blister, provided that the amount of protrusion is sufficient to confine the motion of the contents dosage form within the blister. Preferably, the protruding region has a cross sectional reduction in area of less than about 10 percent relative to the immediately adjacent blister wall.

While blister packs embodying the invention can be used to package a variety of products and dosage forms, the invention is particularly suitable for in situ cast or molded frangible products, including but not limited to pharmaceutical products. In the case of frangible in situ molded dosage forms, the preferred protruding region has a cross sectional reduction in area of about 4 percent relative to the immediately adjacent blister wall.

Frangible in situ molded pharmaceutical dosage forms which can be used in conjunction with the blister packs of the invention include freeze dried pharmaceutical compositions, including but not limited to, rapidly dissolving oral dosage forms such as those disclosed in Pebley et al. in U.S. Pat. No. 5,298,261; Gole et al. in U.S. Pat. Nos. 5,215,756; and 5,120,549; Ecanow in U.S. Pat. Nos. 5,079,018; 5,039,540 and Yamanouchi Pharm. WO 93/12769, the entire texts of which are incorporated herein by reference.

The film 14 used to form the blister 9 can be any deformable polymeric film available in the pharmaceutical packaging field which is adapted to form blisters. Polymeric films which can be used in accordance with the invention can be single or multi-layered and composed of composite materials, sheet materials, or multilaminates. Polymeric films which can be used include, but are not limited to, those composed of thermoplastic materials such as cycloolefin copolymers, polyolefins, polyvinylchloride, polyester and polyamide, and the like. Multilaminate films which can be used in the invention include laminated films containing both polymeric and metallic layers. Preferred multilaminate films for use in the invention are those having an intermediate metallic layer of aluminum foil flanked on either side by polymeric layers. Such preferred multilaminates are described in European Patent Application Nos. 646 367 and 710 101, the entire texts of which are incorporated herein by reference.

The base portion 17 of the blister 9 can further comprise an indicia or mark 20. When in situ cast or molded frangible products or dosage forms are used, a preferred indicia or mark is one which is embossed into the base portion 17 of the blister 9 thereby forming the corresponding complementary indicia directly on the dosage form. Embossing the base portion of the blister can be accomplished by an apparatus having a pin and platen-bearing die, wherein at least one of the end face of the pin and the platen contain an indicia forming surface. Indicia forming surfaces which can be used include those containing a dint or boss. A most preferred arrangement of indicia forming surfaces is one where each of the end face of the pin and platen surface contain complementary indicia forming surfaces, such as a pair of opposing dint and boss.

Blister packs according to the invention can further comprise a lidding or protective cover over the blister in the form of a lidding 16. Any conventional lidding material and technique well-known in the blister packaging art can be used to seal the dosage form in the blister. For example, polymeric sheet layers, metallic sheet layers (e.g., foils), and bonding techniques associated therewith, such as adhesives and the like, can be used.

The resulting overall configuration of the blisters according to the invention exhibit a constricted region, or "neck," located between the opening of the blister and its base. A variety of configurations are possible for the formation of the protruding region of the blister. Protruding regions can be created in the form of a contiguous peripheral protrusion or indentation, such as an inwardly directed annulus on the blister wall. Alternatively, a protruding region can be created in the form of a plurality of inwardly directed projections. In the case of a contiguous peripheral protrusion, the preferred configuration is in the form the inwardly directed annulus (as depicted in FIGS. 1 through 3 and 7).

Figure 5:
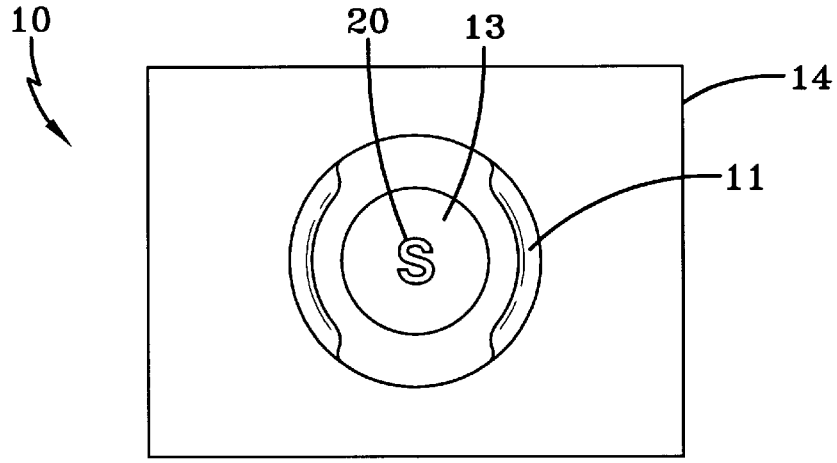
FIG. 5 is a top view of a single unlidded blister having a protruding region in the form of a plurality of inwardly directed projections in accordance with one embodiment of the invention.
Figure 6:
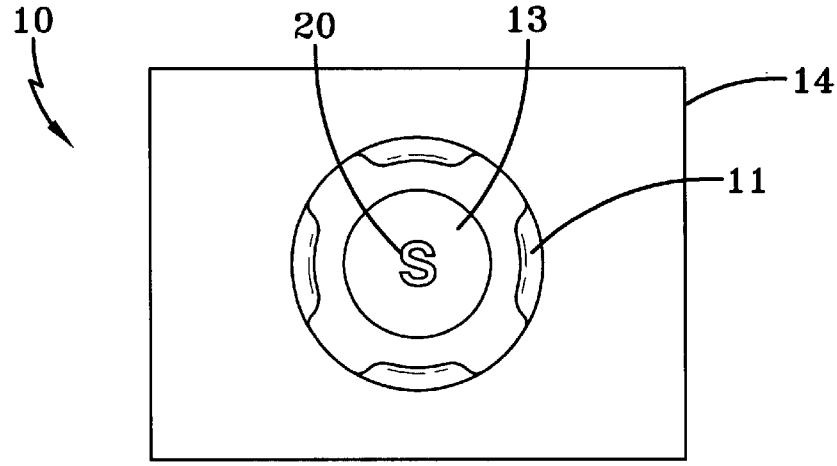
FIG. 6 is a top view of a single unlidded blister having a protruding region in the form of a plurality of inwardly directed projections in accordance with another embodiment of the invention.

In an alternative embodiment, a portion of the blister wall can be indented (as seen in FIGS. 5 and 6) as opposed to a complete contiguous protrusion or indentation, provided the movement of the contents is confined thereby. For example, a protruding region in the form of two or more semicircular protrusions or indents as shown in FIGS. 5 and 6 can be used.

Where the protruding region is formed by a plurality of inwardly directed projections, the number, shape and size of the projections can vary, provided the movement of the dosage form can be confined by virtue of the projections. In one embodiment, at least two elongated projections positioned on opposing sides of the blister wall can be used. In another embodiment, the projections can be in the form of intermittent nodules positioned around the interior wall of the blister.

The overall dimensions, size and shape of the blister can vary, and the dimensions of the blister can be selected in accordance with the intended product or dosage form. Examples of blister shapes which can be used include, but are not limited to, circular, ovoid, square, triangular, rectangular, polygonal and elliptical shapes. The base portion of the blister can be planar, or alternatively, can be hyperbolic such as would be in a hemispherical blister, for example. The base portion of the blister can have a uniform width by virtue of a vertical side wall or, alternatively, have a tapered width wherein the width of the blister gradually increases towards the opening.

The protruding region of the blister of the invention functions to confine the dosage form of the blister between the opening and base, thereby limiting movement of the dosage form during handling and transportation, while at the same time permits removal of the dosage form intact at time of use. Blister packs of the invention can contain a single blister or two or more blisters arranged in series, such as those typically found in conventional blister packs.

Any dosage form which can benefit from reduced movement within a blister pack can be used in conjunction with the invention. Pharmaceutical products, both human and veterinary, can be contained in the blister. A variety of products or dosage forms can be used as well, including but not limited to, tablets, pills, lozenges, capsules, suppositories, and the like. In a preferred embodiment, frangible pharmaceutical dosage forms are used in the blister packs of the invention, because such dosage forms can benefit most from the inventive features of the blister. The invention is particularly useful for in situ cast or molded freeze dried pharmaceutical dosage forms, such as fast dissolving oral dosage forms, which are particularly fragile and responsive to physical forces.

Another aspect of the invention involves a method of packaging a freeze dried pharmaceutical dosage forms comprising depositing the liquid form of the composition into a blister having a protruding region between the opening and base. The method further comprises the step of freeze drying the liquid form of the composition into the solid dosage form prior to lidding or covering the blister to protect the dosage form from the environment. In a preferred embodiment, the freeze dried pharmaceutical composition is a rapidly dissolving oral dosage form. Frangible freeze dried dosage forms can be prepared directly in blister packs using the process disclosed in Thompson et al., U.S. Pat. No. 5,457,895, incorporated herein by reference, for example. A variety of rapidly dissolving oral dosage forms can be in situ molded in conjunction with the blister packs of the invention, for example, Pebley et al. in U.S. Pat. No. 5,298,261; Gole et al. in U.S. Pat. Nos. 5,215,756; and 5,120,549; Ecanow in U.S. Pat. Nos. 5,079,018; and 5,039,540; and Yamanouchi Pharm. in WO 93/12769, the entire texts of which are incorporated by reference.

Figure 4A:
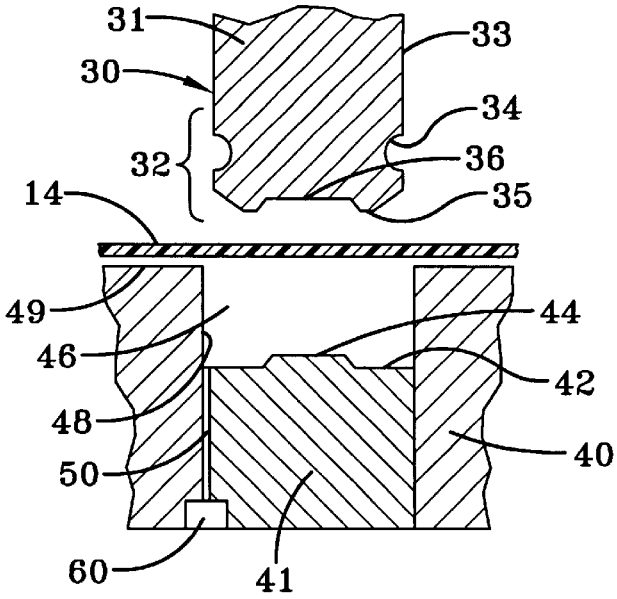
FIGS. 4A, 4B and 4C are cross-sectional side views of an apparatus for forming a blister from film and collectively illustrate the sequential stages of operation in accordance with one embodiment of the invention.
Figure 4B:
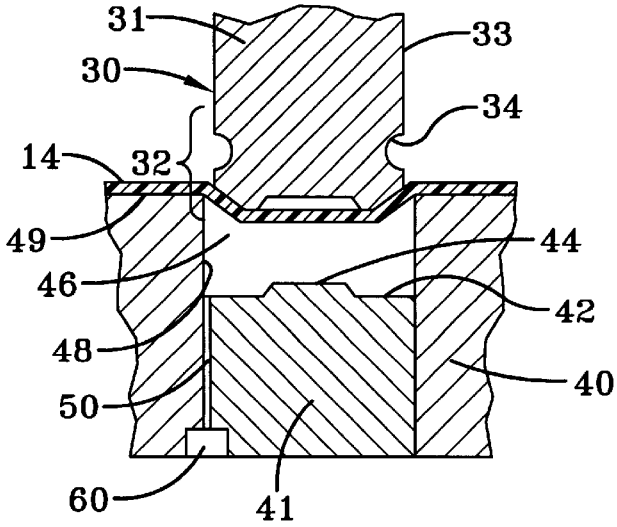
Figure 4C:
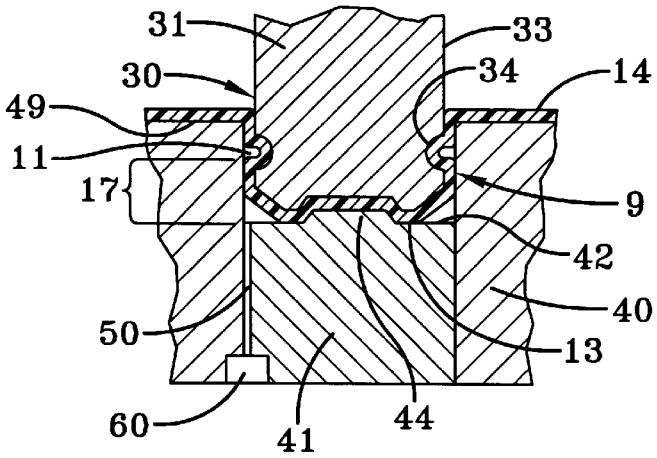

The invention includes an apparatus and method for forming a blister from a deformable film and having a protruding region between the opening and the base. In general, the apparatus comprises a pin and die which are adapted to engage with a deformable film between, such that the pin and die together define the shape of the resulting blister. In accordance with the invention and as depicted in FIGS. 4A, 4B and 4C, the apparatus for forming a blister from a deformable film and having a protruding region between the opening and base comprises a pin 30 having a body 31, end portion 32 and outer surface 33 wherein said outer surface 33 contains at least one peripheral recess 34 on the end portion 32 which defines the protruding region 11 to be formed on the blister 9. The end portion 32 of the pin overall defines the base portion 17 of the blister 9. The apparatus also contains a die 40 adapted to receive the pin 30, the pin being adapted to transversely contact a film 14 positioned between the pin 30 and die 40 and engage the die in a manner which moves the film 14 towards the platen 41. The transverse movement of the pin relative to the film and die is driven by conventional mechanisms used in pin and die assemblies readily available in the manufacturing industry, including the pharmaceutical manufacturing industry.

The pin 30 is constructed such that its outer surface 33 contains a peripheral recess 34 on the end portion 32. The pin overall defines the base portion of the blister to be formed, whereas the peripheral recess receives the portion of the film which defines the protruding region of the resulting blister. Accordingly, the cross sectional area of the pin located at the peripheral recess is less than that of the portion immediately adjacent thereto. The peripheral recess on the pin surface can be configured according to the desired configuration of the protruding region of the blister to be formed. For example, an inwardly directed annulus can be formed using a pin with a peripheral recess having a circumferential groove or indentation surrounding the pin as seen in FIGS. 4A through 4C. In the case of the plurality of inwardly directed projections, the pin surface has recessed areas corresponding to each projection to be formed.

The end portion 32 of the pin 30 has an overall configuration which defines the blister 9 and its base portion 17 formed from contacting the film 14. Accordingly, the overall configuration of the pin can vary based on the desired configuration of the blister to be formed. For example, a circular blister is formed using a pin having an overall cylindrical shape as seen in the Figures. The end portion of the pin is typically rounded, chamfered, frusto-conical, and the like, in order to optimize the molding of the film in the manner desired.

In one embodiment, the apparatus is adapted to form an indicia on the base of the blister. When indicia are applied, preferably at least one of the end face of the pin or the platen surface of the die comprises an indicia forming surface. In a more preferred embodiment and as shown in FIGS. 4A through 4C, the end portion 32 of the pin further comprises an end face 35 having either a dint 36 (as illustrated) or boss on its surface, and the platen surface 42 of the die 40 further comprises the complementary corresponding boss 44 (as illustrated) or dint. The resulting indicia 20 on the base 13 of the blister can be either a positive or negative imprint. When the invention is used together with frangible in situ cast or molded products, the corresponding impression is made directly on the product. In other words, a recessed imprint on the inside of the blister will produce a raised indicia on the contents. Conversely, a raised imprint on the inside of the blister will produce an impressed indicia on the dosage form.

The pin body 31 and die 40 can be composed of any conventional material suitable for use in the manufacturing of blister packs. Examples of typical materials used include, but are not limited to, metals and metallic alloys such as stainless steel, ceramic materials, polymeric materials, and the like. The outer surface of the pin can further comprise a coating, such as polytetrafluoroethylene (PTFE, TEFLON™), to control movement of the film when contacting the pin. The pin surface can also be textured or otherwise modified to more precisely control the stretching of the film. For example, such a modified blister forming apparatus and method is disclosed in U.S. patent application Ser. No. 09/549,127, now pending, the entire text of which is incorporated by reference.

The die 40 contains a recess or chamber 46 adapted to receive the pin 30 together with the superimposed film 14, and a platen 41 located at the base thereof. In addition to the choice of film material, thickness of film, and pin configuration and material, for example, the die itself can be modified to optimize the formation of the protruding region of the blister. It has been found that controlling the pressures created between the film and die chamber can likewise affect the extent of contact of the film within the peripheral recess located on the pin used to form the reduced cross sectional region or indentation of the blister.

In a preferred embodiment of the apparatus and as shown in FIGS. 4A through 4C, the air pressure between the film and die is monitored and controlled during the manufacturing process by way of air pressure control means. Air pressure control means is positioned within the die and is adapted to restrict and/or enlarge the opening through which are flows to and from the chamber. Suitable air pressure control means which can be used includes, but is not limited to, pneumatic mechanisms known in the art. In one embodiment and as shown in FIGS. 4A through 4C, the air pressure control means is in the form of an air pressure conduit 50 in the chamber 46. Accordingly, the die 40 further comprises an air pressure conduit 50 which controls the flow of air to and from the die chamber 46 during the molding process. The air pressure conduit 50 is adapted to restrict the flow of air out of the chamber 46 during engagement of the pin 30 and film 14 into the die 40 thereby maintaining higher pressure within the film-covered chamber 36, and subsequently reduce the negative pressure generated within the chamber 36 as the film-covered pin withdraws from the chamber thereby reducing the likelihood of premature withdrawal of the film 14 from the peripheral recess 34 of the pin 30. The air pressure conduit can be adjusted according to the specific requirements of the particular assembly. Restriction of the conduit restricts the discharge of air during the formation of the film increases positive pressure under the film within the chamber. Enlarging the conduit during withdrawal of the pin enables the control, of negative pressure under the film thereby preventing undesirable partial recovery of the film and loss of shape imparted by the peripheral recess on the pin.

Other blister molding processes can be used, provided such processes can produce a blister according to the invention. Examples of such processes include, but are not limited to, blow forming methods and vacuum forming methods. The invention can also be carried out using hot or cold forming methods.

Formation of the Blister:

The operation of the apparatus and method of the invention is sequentially illustrated in FIGS. 4A, 4B and 4C, the discussion of which is not intended to be construed as a limitation as to the features and methods of the invention. A deformable film 14 is disposed over a die 40 having a planar surface 49, a recess or chamber 46, and platen 41 located at the base thereof. The configuration of the die is selected according to the configuration of the pin which is adapted to engage the die through its chamber. An air pressure control valve 50 is positioned between the platen 41 and the interior wall 48 of the die chamber 46. A key mechanism 60 locks and secures the position of the platen 41 within the die 40.

Above the film 14 is positioned a cylindrical pin 30 which is driven by a mechanism (not shown) which forces the film 14 into the chamber 46 of the die 40. The pin 30 shown contains an end portion 32 tapered or contoured proximal to a planar end face 35. The end face 35 of the pin and platen surface 42 are illustrated as having respective indicia forming surfaces. The engagement of these surfaces with the film between creates the indicia 20 on the base portion 17 of the blister 9. The pin 30 contains a peripheral recess 34 in the form of an annular indentation circumscribing the pin surface. In one embodiment, the pin can have a diameter of about 10 mm, the annular indentation has a depth of about 0.2 mm and a radius of about 1.5 mm.

Upon lowering the pin, the film is initially engaged and the deformation of the film begins (FIG. 4B). The portion of the film 14 immediately beneath the pin 30 is stretched, and additional film material is drawn in from the surrounding area around the chamber as the pin 30 moves to engage the juxtaposed platen 41 of the die 40. Air pressure within the chamber increases during this stage of the process and is forced out through the air pressure control means 50 as the film-covered pin 30 moves toward the lowermost position in the die 40. During this movement, the film 14 closely engages the pin surface, including the peripheral recess 34 assisted by the air pressure within the chamber 46 on the film 14. After the appropriate dwell period, the pin is withdrawn and as it does, air re-enters the chamber through the air pressure conduit 50. In the manufacture of blister packs, a plurality of blisters are normally formed simultaneously using the technique described above, and in either a cold-forming or a thermo-forming process.

In a preferred embodiment of the process of the invention, the blister is cold-formed from a multilaminate film having an intermediate aluminum layer flanked by two polymeric layers of either side. A thermo-forming process would typically be used with multilaminate films absent a metallic intermediate layer.

Blister packs formed in accordance with the invention can be advantageously used to contain either pre-formed products or products formed in situ within the blister. Preferred products for use with the blister packs of the invention are frangible pharmaceutical dosage forms prepared in situ such that the product resides below the protruding region of the blister and completely fills the blister therein.

Preparation of Blister Packs Containing Freeze Dried Pharmaceutical Composition

Figure 7:
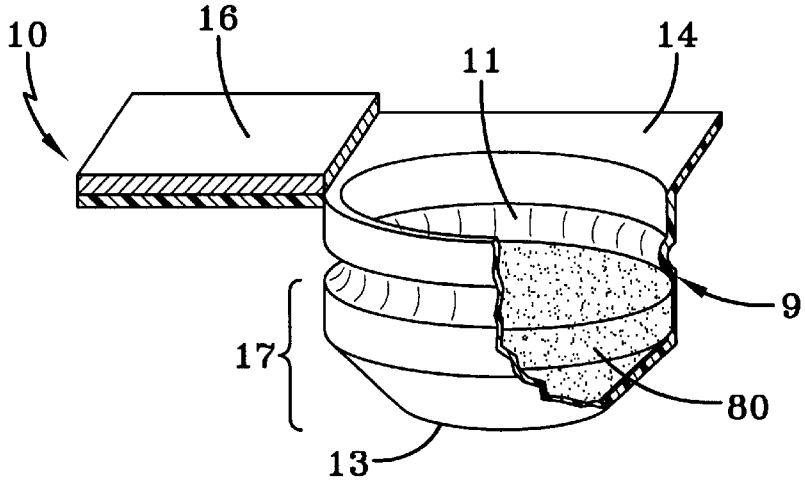
FIG. 7 is a cutaway side view of a single lidded blister pack containing an in situ formed freeze dried pharmaceutical dosage form therein according to one embodiment of the invention.

A blister pack is prepared using the apparatus and method of making the blister as described above. Any conventional freeze drying process can be used using the blister packs of the invention, including for example that described in Gregory et al., U.S. Pat. No. 4,305,502, incorporated herein by reference. Referring to FIG. 7, a predetermined amount of a liquid form of a pharmaceutical composition is deposited directly into each blister 9, the predetermined amount being sufficient to fill the blister up to a level such that when the process is completed, the final solid form resides between the opening 12 and base 13 and at least up to the protruding region 11 of the blister 9. Both the blister together with the liquid composition therein are cooled by using liquid nitrogen or carbon dioxide at reduced pressure, thereby freezing the contents of the blister to form the solid form of the composition 80.

In the case of preparing an in situ molded freeze dried pharmaceutical dosage form within the blisters in accordance with the invention, any known freeze drying process can be used in conjunction with the blister pack of the invention. Freeze dried pharmaceutical dosage forms include those described in Pebley et al. in U.S. Pat. No. 5,298,261; Gole et al. in U.S. Pat. Nos. 5,215,756; and 5,120,549; Ecanow in U.S. Pat. Nos. 5,079,018; and 5,039,540; and Yamanouchi Pharm. in WO 93/12769, the entire texts of which are incorporated herein by reference. The in situ molding technique as disclosed in Thompson et al., U.S. Pat. No. 5,547,895, can likewise be used in the preparation of in situ molded freeze dried dosage forms and is incorporated by reference.

The blisters containing the freeze dried solid dosage forms therein are subsequently covered using a lidding 16 in accordance with conventional techniques in the pharmaceutical packaging field. The resulting blister pack contains the freeze dried oral dosage form 80 confined below the protruding region 11 of the blister 9 as depicted in FIG. 7.

Industrial Applicability:

Blister packs made in accordance with the invention significantly reduce the likelihood of damage to the contents be confining the movement of the product within the blister during manufacture, handling and transportation while still permitting easy removal of the contents intact. These characteristics are especially important in the packaging of frangible pharmaceutical products in which the benefits of the product are associated with its fragile or delicate structure, such as rapidly dissolving oral dosage forms.

The complete disclosures of all patents, patent applications, and publications are incorporated herein by reference as if each were individually incorporated by reference. The invention has been described with reference to various specific and preferred embodiments and techniques. However, it should be understood that many variations and modifications are possible from the foregoing disclosure without departing from either the spirit and scope of the present invention.

What is claimed is:

1. A blister pack for frangible pharmaceutical dosage forms comprising a blister formed from a film and having a laterally protruding region extending inward from a blister side wall between the opening of said blister and its base, said protruding region being structured to confine the movement of a dosage form itch has been formed in situ within the blister, wherein said protruding region comprises an inwardly directed annulus.

2. The blister pack according to claim 1 wherein the amount of protrusion is sufficient to confine the motion of the dosage form within the blister.

3. The blister pack according to claim 2 wherein the protruding region has a cross sectional reduction in area of less than about 10 percent relative tote immediately adjacent blister wall.

4. The blister pack according to claim 3 wherein the protruding region has a cross sectional reduction in area of about 4 percent relative to the immediately adjacent blister wall.

5. The blister pack according to claim 1 further comprising a lidding positioned over said opening of the blister.

6. The blister pack according to claim 1 further comprising a dosage form contained within said blister.

7. The blister pack according to claim 6 wherein said dosage form is positioned below the protruding region of the blister.

8. The blister pack according to claim 6 wherein said dosage form is a freeze dried dosage form.

9. The blister pack according to claim 6 wherein said dosage form is a rapidly dissolving oral dosage form.

10. The blister pack according to claim 1 wherein said blister pack comprises a plurality of blisters.

11. The blister pack according to claim 1 wherein the base of said blister further comprises an indicia.

12. The blister pack according to claim 1 wherein the film used to form the blister is a multilaminate film.

13. The blister pack according to claim 12 wherein the multilaminate film comprises a metallic layer flanked on either side by a polymeric layer.

14. An apparatus for forming a blister from a deformable film and having a protruding region positioned between the opening and base comprising:

a) a pin having a body, end portion and outer surface, wherein said outer surface contains at least one peripheral recess on said end portion and which defines the protruding region to be formed, and wherein said end portion defines the base portion of the blister;

b) a die adapted to receive said pin and having a platen;

wherein said pin is adapted to transversely contact a film positioned between the pin and die and engage said die in a manner which moves said film inside the die;

wherein said peripheral recess on the pin is adapted to permit inward deformation of the film.

15. The apparatus according to claim 14 wherein the amount of protrusion on the blister is sufficient to confine the movement of a dosage form within the blister.

16. The a according to claim 15 wherein the protruding region has a cross sectional reduction in area of less than about 10 percent relative to the immediately adjacent blister wall.

17. The apparatus according to claim 16 wherein the protruding region has a cross sectional reduction in area of about 4 percent relative to the immediately a adjacent blister wall.

18. The apparatus according to claim 14 wherein said peripheral recess circumscribes the outer surface of the pin and is adapted to form an inwardly directed annulus on the blister.

19. The apparatus according to claim 14 wherein said peripheral recess comprises a plurality of peripheral recesses circumscribing the outer surface of the pin and are adapted to form inwardly directed projections on the blister.

20. The apparatus according to claim 14 wherein the apparatus is adapted to form an indicia on the base of the blister.

21. The apparatus of claim 20 wherein at least one of the pin and platen comprises an indicia forming surface.

22. The apparatus according to claim 21 wherein the end portion of the pin comprises an end face having a dint and the platen of the die comprises a surface having a boss, said dint and boss being complementary.

23. The apparatus according to claim 21 wherein the end portion of the pin comprises an end face having a boss and the platen of the die comprises a surface having a dint, said dint and boss being complementary.

24. A The apparatus according to claim 14 further comprising air pressure control means located in the die.

25. A method of forming a blister from a film having a protruding region between the opening and base thereof comprising:

a) positioning a deformable film between a pin and die, said pin having an end portion and an outer surface and further having at least one peripheral recess on said outer surface at the end portion which defines the protruding region of the blister; and b) engaging said pin and die in a manner whereby the pin defines the blister and said recess on the outer surface of the pin receives a portion of the film and defines the protruding region of the blister.

26. The method according to claim 25 wherein the amount of protrusion is sufficient to confine the motion dosage form within the blister.

27. The method according to claim 26 wherein the protruding region has a cross sectional reduction in area of less than about 10 percent relative to the immediately adjacent blister wall.

28. The method according to claim 27 wherein the protruding region has a cross sectional reduction in area of about 4 percent relative to the immediately adjacent blister wall.

29. The method according to claim 25 wherein the protruding region is formed by positive air pressure forcing the film inward into the peripheral recess on the pin.

30. The method of claim 25 wherein the film deforms to form an inwardly directed annulus.

31. The method of claim 25 wherein the film deforms to form a plurality of inwardly directed projections.

32. The method of claim 25 further comprising forming an indicia on the base on the blister.

33. A method of packaging a frangible pharmaceutical dosage form comprising:

a) depositing the frangible dosage form into a blister having a laterally protruding region extending inward from a blister side wall between the opening and base of said blister, said frangible dosage form being formed in situ within said blister, and said protruding region comprising an inwardly directed annulus;

b) lidding said blister containing the dosage form to protect the dosage farm from the environment.

34. The method of claim 33 wherein the amount of protrusion is sufficient to confine the motion of dosage form within the blister.

35. The method of claim 34 wherein the protruding region has a cross sectional reduction in area of less than about 10 percent relative to the immediately adjacent blister wall.

36. The method of claim 35 wherein the protruding region has a cross sectional reduction in area of about 4 percent relative to the immediately adjacent blister wall.

37. The method of packaging according to claim 33 wherein the frangible dosage form is a freeze dried dosage form.

38. The method of packaging of claim 33 wherein the frangible dosage form is a rapidly dissolving oral dosage form.

39. A method of forming a freeze dried pharmaceutical dosage form comprising:

a) depositing the liquid form of a pharmaceutical composition into a blister having a laterally protruding region extending inward from a blister side wall between the opening and the base of said blister, wherein said protruding region comprises an inwardly directed annulus;

b) freeze drying said liquid composition in situ within the blister to form the freeze dried dosage form.

40. The method according to claim 39 wherein the amount of protrusion is sufficient to confine the movement of the dosage form within the blister.

41. The method according to claim 40 wherein the protruding region has a cross sectional reduction in area of less than about 10 percent relative to the immediately adjacent blister wall.

42. The method according to claim 41 wherein the protruding region has a cross sectional reduction in area of about 4 percent relative to the immediately adjacent blister wall.

43. The method of claim 39 wherein the freeze dried pharmaceutical dosage form is a rapidly dissolving oral dosage form.

44. The method according to claim 39 wherein the dosage form resides between the opening and base and at least up to the protruding region of the blister.

* * * * *